United States Patent [19]

Tajima

[11] Patent Number: 4,738,554

[45] Date of Patent: Apr. 19, 1988

[54] MEANS FOR PREVENTING ELECTRIFICATION OF AN INK RIBBON CASSETTE

[75] Inventor: Akio Tajima, Tokyo, Japan

[73] Assignee: Seikosha Co., Ltd., Tokyo, Japan

[21] Appl. No.: 894,720

[22] Filed: Aug. 8, 1986

Related U.S. Application Data

[63] Continuation of Ser. No. 683,372, Dec. 19, 1984, abandoned.

[30] Foreign Application Priority Data

Dec. 21, 1983 [JP] Japan ..... 58-196551[U]

[51] Int. Cl.[4] ..... B41J 32/02

[52] U.S. Cl. ..... 400/196; 400/208

[58] Field of Search ..... 400/194, 195, 196, 196.1, 400/207, 208, 208.1, 248.3, 249; 361/212, 214, 222

[56] References Cited

U.S. PATENT DOCUMENTS

| | | | |
|---|---|---|---|
| 4,115,013 | 9/1978 | Hedstrom | 400/208 X |
| 4,325,645 | 4/1982 | Miyajima et al. | 400/208 X |
| 4,347,549 | 8/1982 | Fechner | 361/212 |
| 4,407,593 | 10/1983 | Haftmann | 400/208 |
| 4,451,166 | 5/1984 | Frechette et al. | 400/208 |

FOREIGN PATENT DOCUMENTS

| | | | |
|---|---|---|---|
| 148682 | 9/1982 | Japan | 400/694 |
| 138649 | 9/1983 | Japan | 400/208 |
| 378156 | 8/1932 | United Kingdom | 361/222 |

*Primary Examiner*—Charles A. Pearson

*Attorney, Agent, or Firm*—Bruce L. Adams; Van C. Wilks

[57] ABSTRACT

Grounding members are provided on support plates for an ink ribbon cassette, the support plates are secured to a chassis. The support plates and the chassis are both made of electrically conductive material. When an ink ribbon cassette is placed on the support plates, the grounding members contact the ink ribbon to ground static electricity.

5 Claims, 2 Drawing Sheets

MEANS FOR PREVENTING ELECTRIFICATION OF AN INK RIBBON CASSETTE

This is a Rule 62 continuation application of application Ser. No. 683,372 filed Dec. 19, 1984 which claims priority of Japanese Patent Application No. 196551/83 filed Dec. 21, 1983, now abandoned.

BACKGROUND OF THE INVENTION

The present invention relates to means for preventing electrification of an ink ribbon cassette.

Nowadays, in a printer or a typewriter, the case and many other parts of an ink ribbon cassette are made of synthetic resin. And it is necessary to provide a means for preventing the action of static electricity which is produced by friction between the ink ribbon and the guide rollers and the like. Once static electricity occurs, the smooth operation of the ink ribbon is hindered and the printer or the typewriter may operate erroneously due to the discharge of the accumulated static electricity.

In order to prevent any adverse effect due to static electricity, in one prior art system, a grounding point is provided at a printing head so that electric current may flow from the grounding point to a chassis through a flexible flat cable. And in another prior art system, a grounding point is provided in an ink ribbon cassette and the grounding point is designed to contact a chassis when the ink ribbon cassette is placed in the chassis.

In the former prior art system in which a grounding point and a flat cable are employed, the number of wires in the flat cable is increased and the flat cable becomes wide so that high costs result. And in the latter prior art system in which a grounding point is provided in the ink ribbon cassette, there is present a mechanical contact point between the grounding point and the chassis, and such a structure tends to result in insufficient electrical contact and, in addition, the number of parts is increased.

SUMMARY OF THE INVENTION

The present invention eliminates the disadvantages of the prior art.

According to a feature of the present invention there is provided a means for preventing electrification of an ink ribbon cassette comprising, a chassis made of electrically conductive material, at least one support plate for an ink ribbon cassette made of electrically conductive material, said support plate being secured to said chassis, at least one grounding element supported on said support plate, and an ink ribbon cassette provided with an aperture through which said grounding member protrudes, whereby said ink ribbon cassette can be placed on said support plate with said grounding member contacting the ink ribbon in said ink ribbon cassette.

One object of the present invention is to provide a means for preventing electrification of an ink ribbon cassette in which grounding can be effectively carried out.

Another object of the present invention is to provide a means for preventing electrification of an ink ribbon cassette which is simple in structure and can be fabricated with only a small number of parts.

The above objects, other objects and characteristic features of the present invention will be fully understood from the following description and claims taken in conjunction with the accompanying drawings.

DETAILED DESCRIPTION OF PREFERRED EMBODIMENT

Figure 1:
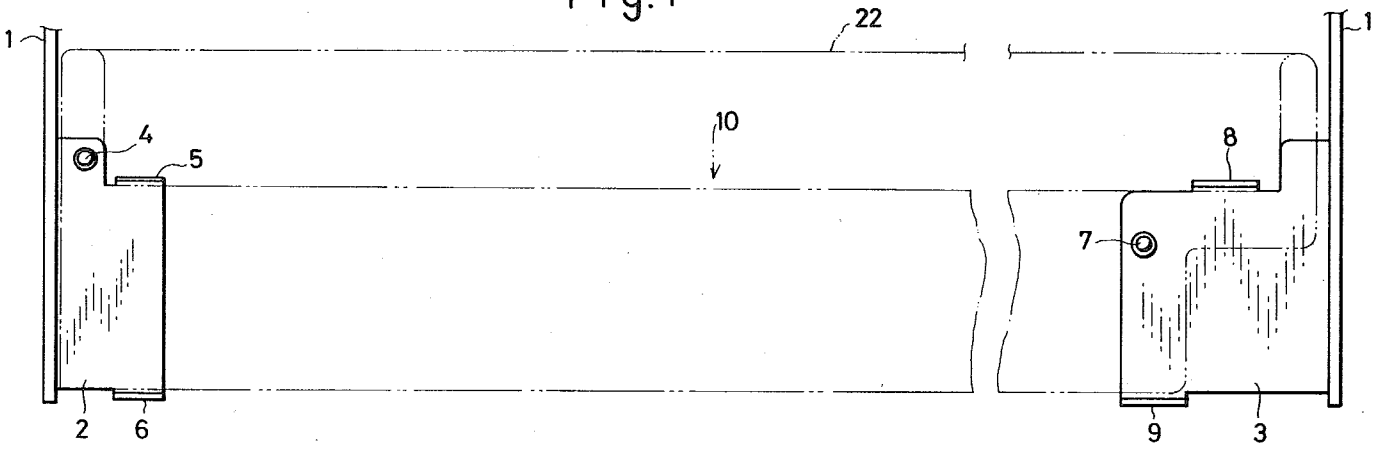
FIG. 1 is a plan view of support plates for an ink ribbon cassette, which are secured to a chassis.
Figure 2:
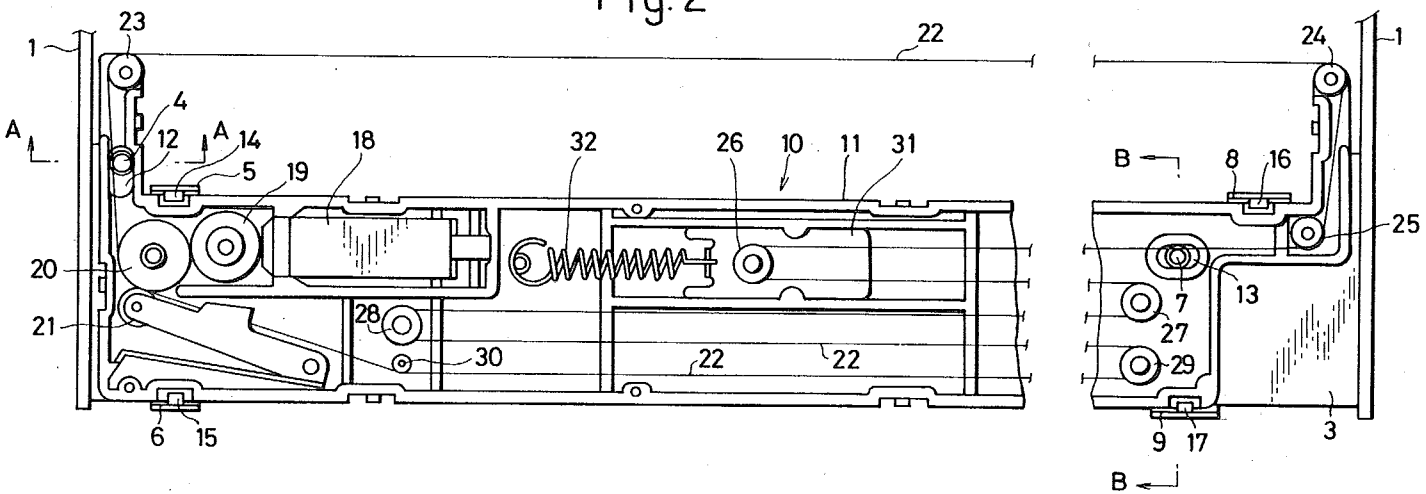
FIG. 2 is a plan view of the ink ribbon cassette with its upper case removed.
Figure 4:
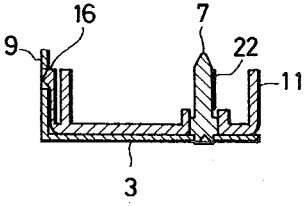
FIG. 4 is a sectional view along lines B—B in FIG. 2.
Figure 3:
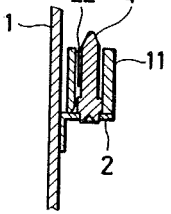
FIG. 3 is a sectional view along lines A—A in FIG. 2.

In FIG. 1, a chassis 1 of a printer is made of electrically conductive material. Two support plates 2,3 for an ink ribbon cassette are secured to the two sides of the chassis 1. These support plates 2,3 are also made of electrically conductive material. A grounding member 4 made of electrically conductive material is mounted on the support plate 2. The support plate 2 is provided at its two ends with engagement members 5,6 extending upwardly from the plate 2. The support plate 3 is also provided with a grounding member 7 and engagement members 8,9. Referring to FIG. 2, a lower case 11 of an ink ribbon cassette 10 is provided with two elongated apertures 12,13 through which the grounding members 4,7 respectively protrude. The ink ribbon cassette 10 is provided at four points with engagement projections 14,15, 16,17 which respectively engage with the engagement members 5,6,8,9, thereby securing the ink ribbon cassette on the support plates 2,3. When the ink ribbon cassette 10 is placed on the support plates 2,3, the grounding members 4,7 protrude through the apertures 12,13 respectively. The reason the apertures 12,13 are not of circular shape but rather are elongated is that when the ink ribbon cassette 10 is made of synthetic resin some allowance is required to compensate for error due to shrinkage of the synthetic resin. The ink ribbon cassette 10 is further provided with an ink cartridge 18, transfer rollers 19,20 and a biasing roller 21. An ink ribbon 22 is driven forwardly between the transfer roller 20 and the biasing roller 21 as the transfer roller 20 rotates. The ink ribbon 22 is endless and supported by guide rollers 23,24,25,26,27,28,29 and a guide pin 30 in a zigzag configuration. The guide roller 26 is rotatably supported on a slide member 31. A coil spring 32 is secured at one end to the slide member 31 and at its other end thereof to a pin fixed on the lower case 11. Thus the slide member 31 is always biased leftwards in FIG. 2 and the ink ribbon 22 is always kept tight. The grounding members 4,7 mounted on the support plates 2,3 protrude into the cassette case for contact with the ink ribbon 22.

In operation, as the printing operation begins, the ink ribbon 22 frictionally contacts a print head (not shown in the drawings), the guide rollers 23–29 and the guide pin 30 and acquires static electricity. But the static electricity is not stored in the ink ribbon, since it is grounded down to the chassis 1 through the grounding members 4,7 and the support plates 2,3.

In the embodiment described above two grounding members 4,7 are provided but the number of such members is not critical.

According to the present invention grounding can be efficiently effected since the grounding members secured on the support plates directly contact the ink ribbon.

What is claimed is:

1. In combination: an electrically grounded chassis comprised at least in part of electrically conductive material; an ink ribbon cassette removably mounted in a predetermined position on the chassis, the ink ribbon cassette being comprised of electrically non-conductive material and containing an endless ink ribbon disposed to undergo lengthwise movement along a given path of travel; and grounding means electrically connected to the grounded chassis and operative when the ink ribbon cassette is mounted in the predetermined position on the chassis to make continuous sliding contact with the ink ribbon as the ink ribbon moves along its path of travel to thereby electrically ground the ink ribbon through the grounded chassis so as to provide a discharge path for static electricity accumulated in the ink ribbon, the grounding means comprising two electrically conductive grounding members electrically connected to the grounded chassis and projecting through respective elongated through-holes in the ink ribbon cassette to make sliding contact with the ink ribbon, the two grounding members being located in spaced-apart relation, and the elongated through-holes being similarly located in spaced-apart relation and being positioned with their directions of elongation extending in different directions so as to enable adjustable positioning of the ink ribbon cassette to position the same in the predetermined position on the chassis.

2. A combination according to claim 1; including a pair of electrically conductive support members secured to the chassis in spaced relation from one another and in electrical contact with the chassis, each support member being electrically connected to and carrying one of the grounding members.

3. A combination according to claim 1; wherein the through-holes in the ink ribbon cassette have sufficient elongation to provide tolerance for insertion of the grounding members therethrough during mounting of the ink ribbon cassette in the predetermined position on the chassis.

4. A combination according to claim 3; wherein the ink ribbon cassette is composed of synthetic resin.

5. A combination according to claim 1; wherein each grounding member has a cylindrical shape and projects into the ink ribbon cassette a distance far enough to ensure that the entire width of the ink ribbon contacts the grounding member as the ink ribbon moves along its path of travel.

* * * * *